US009561402B2

(12) United States Patent
Fogarty

(10) Patent No.: US 9,561,402 B2
(45) Date of Patent: Feb. 7, 2017

(54) LAUNCHABLE FLYING DEVICE

(76) Inventor: Shaun P. Fogarty, Portland, OR (US)

( * ) Notice: Subject to any disclaimer, the term of this patent is extended or adjusted under 35 U.S.C. 154(b) by 0 days.

(21) Appl. No.: 13/372,478

(22) Filed: Feb. 13, 2012

(65) Prior Publication Data

US 2012/0289369 A1 Nov. 15, 2012

Related U.S. Application Data

(60) Provisional application No. 61/442,292, filed on May 14, 2011.

(51) Int. Cl.

| | |
|---|---|
| ***A63B 41/00*** | (2006.01) |
| ***A63B 43/00*** | (2006.01) |
| ***A63B 65/00*** | (2006.01) |
| ***A63B 69/00*** | (2006.01) |

(52) U.S. Cl.

CPC ..... *A63B 43/00* (2013.01); *A63B 65/00* (2013.01); *A63B 69/002* (2013.01); *A63B 2208/12* (2013.01); *A63B 2225/01* (2013.01)

(58) Field of Classification Search

CPC ..... A63B 65/00; A63B 43/00; A63B 2225/01; A63B 2208/12

USPC ..... 473/613, 578, 612, 615; 446/34, 61, 71

See application file for complete search history.

(56) References Cited

U.S. PATENT DOCUMENTS

| | | | | | |
|---|---|---|---|---|---|
| 2,683,603 | A | * | 7/1954 | Gackenbach | 473/613 |
| 3,264,776 | A | * | 8/1966 | Morrow | 446/34 |
| 3,951,070 | A | * | 4/1976 | Flatau et al. | 102/502 |
| 3,982,489 | A | * | 9/1976 | Flatau et al. | 102/502 |
| D247,923 | S | * | 5/1978 | Bartz | D21/707 |
| 4,390,148 | A | * | 6/1983 | Cudmore | 244/19 |
| 4,790,788 | A | * | 12/1988 | Hill | 446/61 |
| 4,850,923 | A | * | 7/1989 | Etheridge | 446/34 |
| 4,955,620 | A | * | 9/1990 | Reinke | 473/613 |
| 5,067,922 | A | * | 11/1991 | McMahon | 446/71 |
| 5,123,645 | A | * | 6/1992 | MacDonald et al. | 473/594 |
| 5,152,709 | A | * | 10/1992 | Johnson et al. | 446/71 |
| 5,171,021 | A | * | 12/1992 | Orak | 473/607 |
| 5,306,191 | A | * | 4/1994 | Phillips et al. | 446/61 |
| 5,397,261 | A | * | 3/1995 | Malewicki et al. | 446/71 |
| D388,133 | S | * | 12/1997 | Forti et al. | D21/444 |
| 5,810,637 | A | * | 9/1998 | Mileti | 446/61 |
| 5,816,880 | A | * | 10/1998 | Forti et al. | 446/61 |
| 6,220,918 | B1 | * | 4/2001 | Laronge | 446/63 |
| 7,662,012 | B2 | * | 2/2010 | Wright | 446/34 |

* cited by examiner

*Primary Examiner* — Steven Wong
(74) *Attorney, Agent, or Firm* — Frank Marino

(57) ABSTRACT

A launchable or throwable flying device that comprises a tapering tube or hollow truncated cone shape with a front aperture that is larger in diameter than the rear aperture. Various aerodynamic and design features are designed to optimize the device's performance in flight, such as (but not limited to) a tail section that induces the device to tack into the wind when thrown.

3 Claims, 8 Drawing Sheets

LAUNCHABLE FLYING DEVICE

BACKGROUND OF THE INVENTION

People worldwide play a number of indoor and outdoor sports, games, and contests that utilize a thrown object or device, such as soccer, baseball, tennis, basketball, football, ultimate, shot put, discus, and javelin. In the sport of American football, the regulation football itself—for professional or collegiate leagues—is a pressurized air bladder weighing about four hundred twenty grams when inflated; smaller counterparts for children's leagues weigh approximately two hundred grams. These pneumatic footballs are usually made out of combinations of materials such as natural or synthetic leather (including the traditional "pigskin"), natural or synthetic rubber, and, in many cases, fabric or polyvinyl chloride laces.

These regulation footballs are designed to be rather incompressible when pressurized in order to provide a ball that can be readily clutched when caught or carried and that has appropriate spring when kicked. One downside to these footballs is that they can be quite stiff and hard when striking a person or object. The ends of the regulation football particularly, which are constructed by leather and rubber material folded in on itself, can be particularly hard and pointed.

A top-tier professional or collegiate quarterback can throw a regulation football up to seventy yards in the air. In order to extract this level of performance, the athlete must be very fit and much practiced at throwing the football.

This action of throwing the football can also be considered "launching" the football, since a football has a shape, design details, and distribution of mass sufficient to perform well as an aerodynamic device if launched within a certain set of parameters. In fact, automatic football passing machines are often used for practice and training drills for football players from children through adult (see, e.g., http://jugssports.com/productdetalaspx?id=625; http://www.livestrong.com/article/350290-football-throwers-for-kids; http://menversus.com/articles/Training-the-receivers-of-tomorrow; and U.S. Pat. Nos. 3,662,728; 4,261,319; and 5,207,421; and 6,718,961).

When launched or thrown, a football is moved in both the forward and upward directions to create a trajectory. The distance and duration of the football's flight is greatly enhanced if it is launched with the smallest possible frontal area of the ball facing the direction perpendicular to the trajectory, in order to minimize drag.

The flight of the football is further enhanced in terms of duration, accuracy, and stability if spinning is induced by the user or launching device as the ball is released (i.e., the desired, if misleadingly titled, "spiral" throw is achieved). This spinning around the longitudinal axis creates angular momentum that, in a regulation football, is stored in the mass of the bladder and its cover that define the shape of the football. This angular momentum serves to maintain the football as close as possible to the most efficient aerodynamic orientation: spinning perfectly around its longitudinal axis with as great a rate of rotation as possible. In football terms, this flight characteristic and orientation is known as a "tight spiral." Thus, the angular momentum imparted by the user, or launching device, is critically important to ensuring the football is thrown as far as possible.

In an effort to minimize some of the safety issues described above, and further to bring football into certain indoor spaces (such as gymnasia and field houses), Parker Brothers introduced the Nerf® foam footballs that have proliferated until becoming a ubiquitous part of American culture. The prototypical foam football is a single mass of closed-cell foam weighing approximately two hundred grams. Due to its lower mass and energy absorptive nature, it is much safer in outdoor environments. However, it is not suitable for all situations because it still weighs enough to damage delicate or fragile objects.

Many of these problems that plague pneumatic and foam footballs also affect the thrown devices utilized in other activities (e.g., soccer, baseball, discus, javelin), such as those identified above.

Foam footballs are injection-molded and produce a ball of the same general shape as a regulation football. The injection-molding manufacturing technique initially produced foam footballs of nearly constant mass comprising single-density foam with a thin skin. Foam balls are significantly less likely to inflict personal injury or property damage when in use. However, foam footballs are not capable of being thrown as far as pneumatic footballs because they have less mass, because their uniform density cannot store as much angular momentum, and because of the energy-absorbing and energy-dampening characteristics of the foam.

The mass of the single-density foam ball is evenly distributed inside the entire volume of the ball, reducing the opportunity for the user to impart angular momentum via the spinning of the ball at launch. This absence of angular momentum results in a more rapid decay of the spin of the football, to levels at which the axial orientation of the ball rapidly succumbs to the force of air and enters into a tumble, which greatly increases the frontal area of the ball (and, therefore, drag), further decaying aerodynamic efficiency and cutting short the flight trajectory.

More recently, foam footballs balls have been co-molded with two or three densities of foam. For example, recent highly stylized foam footballs have a core of higher-density (heavier) foam, surrounded by lower-density (lighter) foam, and surfaces with embossed surface details. They perform more poorly than the early foam footballs due to the ineffective distribution of the majority of the mass, near the spinning axis, and the aerodynamic drag caused by the design details on the surface of the football.

The reduced performance of foam footballs may be considered by some a reasonable a trade-off for the corresponding improvement in safety, but one key trait of the pneumatic football remains. The distinct shape, and spring characteristics (large single-cell dynamically charged pneumatic spring characteristics in inflated footballs; small multi-cell dynamically charged pneumatic spring characteristics in foam footballs), of a football lead to this characteristic: when a football strikes the ground, it bounces off in a wildly variable, multi-axis trajectory. On subsequent bounces will often entirely change both direction and spin, continuing with this random, chaotic movement until the energy imparted at launch is depleted.

While this characteristic is an essential part of the game of football, it can be an inconvenience or safety hazard when footballs are used outside of designated football fields. In front yards, streets, and parks all across America, people who play catch with footballs endure this chaotic dynamic of the crazily bouncing football. Sometimes very real damage is done to individuals and property by thrown or bouncing footballs. Although of diminished amplitude in foam footballs due to the dampening effect of the foam material, this trait still results in wayward foam footballs bouncing into others' picnics and, with children in pursuit, onto busy streets.

BRIEF SUMMARY OF THE INVENTION

The launchable flying device was conceived and designed by the inventor in order to address various needs including, but not limited to, a need for an easily throwable and catchable device, similar to a ball, which was inherently safe, provided high performance, and was manufacturable using existing methods and materials. However, this launchable flying device has many uses across multiple industries and applications and is not intended to be limited to purely recreational use. For example, and without limitation, the launchable flying device can be fitted with various sensors and launched or dropped (e.g., from an aircraft) to provide weather or ground observation data. As another purely illustrative example, the launchable flying device may be fitted with (or, indeed, may consist of) a munitions payload and fired as an artillery round within a sabot.

The device comprises a hollow truncated cone shape with a front aperture that is larger in diameter than the rear aperture. The device features greatly increased aerodynamic efficiency and performance over traditionally shaped footballs when used in football-type play, and improved safety and play due to greatly reduced caroms. Since the device has low-profile, open ends rather than the pointed areas of a pneumatic or foam football, the device offers high aerodynamic efficiency combined with self-correcting mass-driven trajectories that allow the device to be easily and more predictably caught and thrown. Optionally, the device comprises one or more grooves or raised grips to assist the thrower or launcher in throwing or launching the device.

In some embodiments, the rearmost section of the device acts as a tail, reacting to wind by turning the longitudinal spinning axis of the device "into" the wind. This enables the device to "tack" into the wind even as the center of mass maintains the initial direction imparted at launch.

Various aerodynamic and design features are designed to optimize the device's performance in flight. At the beginning of its flight trajectory, the low frontal area of the device allows for an efficient initial throw. At the apex of the flight trajectory, the device enters a soft stall before gravity pulls the front edge of the device downward, returning the device to an orientation with low frontal area and thus increasing the velocity of the device. As the device enters the final phase of the flight trajectory, the tube wall airfoil utilizes the speed gained after the apex of the flight trajectory to generate lift that flattens the flight trajectory and extends the flight distance of the device. Thus the device exhibits improved flight characteristics compared to traditional and foam footballs.

DETAILED DESCRIPTION OF THE INVENTION

Disclosed is a launchable flying device capable of being thrown or launched predictably for long distances. What the inventor sought out to accomplish was a safe, soft, throwable, and catchable device that: was suitable for casual games of catch or football in parks, front yards, streets, backyards and suitable indoor spaces; has superior aerodynamic and flight characteristics; has low mass and high dampening characteristics for impact safety; and has a greatly reduced bouncing dynamic both in distance and randomness.

This launchable flying device is useful in a variety of applications in addition to recreation and sports. Such applications include (but are not limited to): image and data collection; hunting; munitions delivery; and creating visual displays.

Particularly novel and innovative features include, but are not limited to, combinations of two or more of the following: (1) the device being comprised of a tapering tube (i.e., a device in the shape of a hollow truncated cone) with a front aperture, a tube wall, and a rear aperture; (2) the front aperture has a greater diameter than the rear aperture; (3) the distance between the center of the front aperture and the center of the rear aperture is greater or equal to about one hundred percent (100%) and less than or equal to about four hundred percent (400%) of the length of the outermost diameter of the tube wall; (4) the distance, along the long axis, from the front edge of the device to the center of mass is between about five percent (5%) and about thirty percent (30%) of the overall length of the device measured from the plane of the front aperture to the plane of the rear aperture; and (5) the length of the rear aperture diameter is between seventy percent (70%) and ninety-five percent (95%) of the length of the front aperture diameter.

In some embodiments, the wall of the tapering tube has a substantially uniform circumferential thickness (i.e., when seen in cross section, the thickness of the tube wall is substantially uniform around the circumference of the section), but varies in thickness down the length of the tube. In other embodiments, the wall of the tapering tube is substantially uniform both circumferentially and along its length, while in still other embodiments, the thickness of the tube wall varies both circumferentially and along the length of the tube wall. In particular embodiments, the wall of the tapering tube varies in thickness along the long axis of the device and forms one or more cambered airfoils.

The thickness of the tube wall also affects the distribution of mass around the tube itself. In some embodiments, the mass of the tapering tube is distributed in a radially symmetrical or axisymmetrical manner around the long axis of the device.

Figure 1:
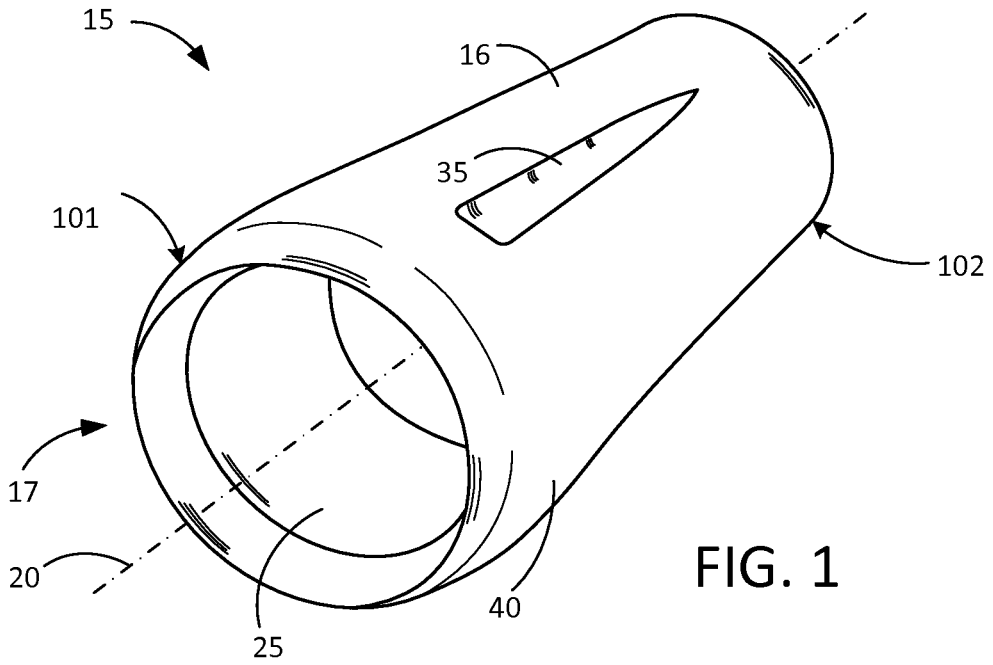
FIG. 1 is a front perspective view of an exemplary embodiment of the launchable flying device as a toy that can be thrown or otherwise launched.
Figure 2:
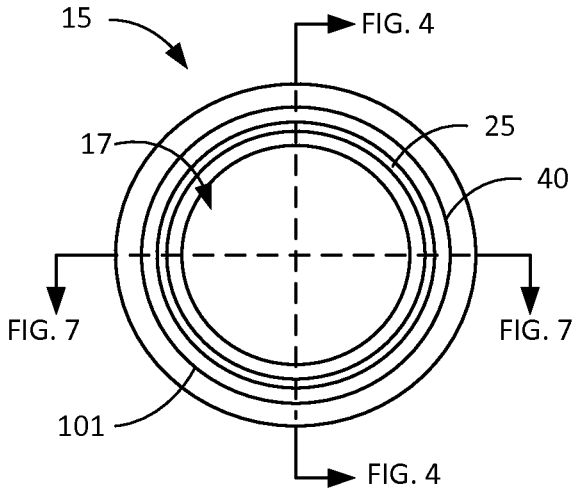
FIG. 2 is an end view of the device of FIG. 1 as seen from the leading, or front, edge.
Figure 3:
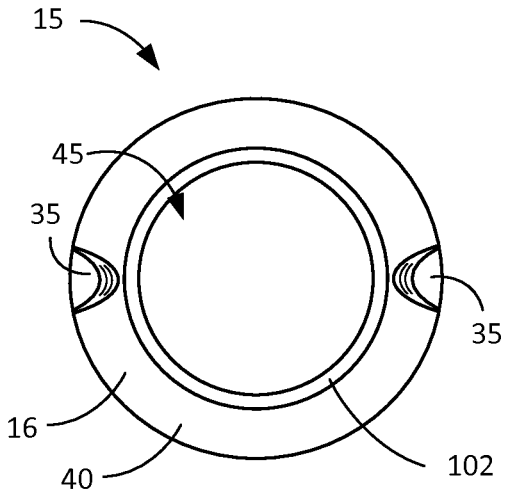
FIG. 3 is an end view of the device of FIG. 1 as seen from the trailing, or rear, edge.

FIG. 1 depicts an exemplary embodiment of the launchable flying device, generally indicated at 15. FIG. 2 depicts the device 15 as viewed from the front edge 101. FIG. 3 depicts the device 15 as viewed from the rear edge 102. As shown in FIGS. 2 and 3, the device 15 comprises a tapering tube comprising a tube wall 16; having a front aperture 17 with its perimeter being defined by the front edge 101; and having a rear aperture 45 with its perimeter being defined by the rear edge 102. A spinning axis 20 comprises a line drawn through the centers of the apertures 17 and 45.

It can be seen that the apertures 17 and 45 of the device 15 are substantially circular and substantially concentric to each other, and that the tube wall 16 is substantially radially symmetrical around the spinning axis 20. It can also be seen that the front aperture 17 has a greater diameter than the rear aperture 45. In some embodiments of device 15, the length of the diameter of the rear aperture 45 is between about seventy percent (70%) and about ninety-five percent (95%) of the length of the diameter of the front aperture 17. In particular embodiments, the rear aperture diameter is about eighty-five percent (85%) of the length of the front aperture diameter.

In particular embodiments of the device 15 illustrated in FIGS. 1 and 2, the tube wall 16 comprises a stiff sleeve 25, which forms most of the inside of the portion of the tube wall 16 that lies between the front aperture 17 and the middle of the device 15, coupled to a foam portion 40 that completely surrounds the sleeve 25 on the inside of the tube wall 16 and forms the front edge 101, the outside, and the rear edge 103 of the tube wall 16. In more particular embodiments, the sleeve 25 can be completely enclosed by the foam portion 40 of the tube wall 16. The stiff sleeve 25 may be comprised of any suitable material including (but not limited to): plastic or thermoplastic, such as polypropylene, polyethylene, or polyvinylchloride; metal or alloy, such as aluminum, copper, steel, tungsten, or titanium; wood, such as balsa, bamboo, or wood veneers; composite materials, such as Kevlar or carbon fiber; or combinations thereof. The foam portion 40 may be comprised of any suitable material including (but not limited to) low-density or medium-density plastic or rubber foams, such as polyethylene foam, polystyrene foam, open-cell or closed cell polyurethane, low-density polyethylene (LDPE), or expanded polypropylene (EPP), neoprene, or combinations thereof.

FIGS. 1 and 3 depict two longitudinal grooves 35 in the tube wall 16. Such straight longitudinal grooves or, alternatively, grooves that curve relative to the long axis of the device, can be added in any quantity to any embodiment of the device, to enhance the ability of the user or launcher to grip, launch, and spin the device by providing a grip to enhance the impartation of rotational energy when the thrower throws the device. Also, the groove or grooves provide a sensory cue to the thrower's fingers, indicating where the device should be held when thrown. Curved grooves enhance spin and angular momentum in certain circumstances, particularly during certain types of launching.

Figure 4:
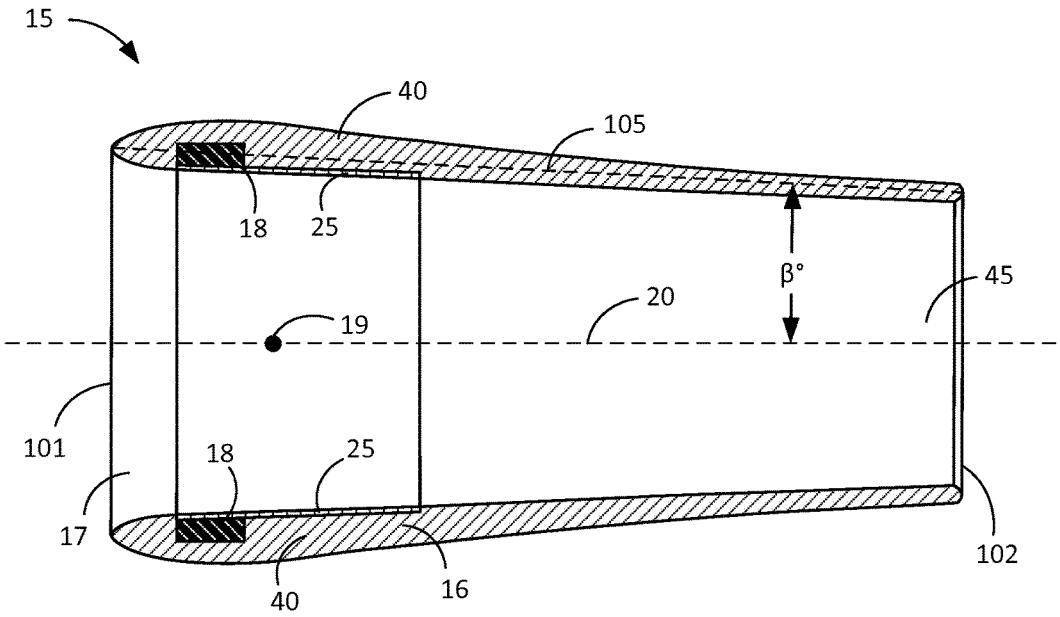
FIG. 4 is a side view of a longitudinal section of the device of FIG. 1, as viewed along line 4-4 of FIG. 2, that illustrates its cambered airfoil shape and that also shows the approximate center of mass of the device when it is not in motion.

FIG. 4 depicts a side view of a longitudinal section of the device 15. It can be seen that in this embodiment, the tapering tube wall 16 varies in thickness and thus comprises a single cambered airfoil, approximately twice as long as the outermost diameter of the device 15. A chord line 105 connects the point of maximum curvature of the front edge 101 of the airfoil to the point of maximum curvature of the rear edge 102 of the airfoil. In one very particular, non-limiting embodiment of the device 15, the outermost diameter of the device 15 is approximately four inches and the length of the tapering tube wall 16 is approximately eight inches.

FIG. 4 also shows that the device 15 is configured such that that the planes of apertures 17 and 45 are substantially parallel to each other and substantially perpendicular to the spinning axis 20. The relationship between the diameter of the larger front aperture 17 and the diameter of the smaller rear aperture 45 in the device 15 is such that the chord line 105 of the tube wall airfoil 16 tapers consistently, relative to the spinning axis 20, at an angle $\beta$ of from about two degrees (2°) to about four degrees (4°) along the length of the device 15.

In alternative embodiments, not shown here, the tube wall 16 does not taper at a consistent angle from front to back but instead tapers at a variable angle along the length of the device 15. In particular embodiments, the tube wall 16 tapers along only a portion of its length from front to back. In one particular, non-limiting embodiment, the tube wall 16 tapers at an angle of about one degree (1°) to about four degrees (4°) relative to the spinning axis 20 along a front portion of its length, but is substantially cylindrical along a rear portion of its length (i.e., angle $\beta$ is about zero in the cylindrical portion).

FIG. 4 also depicts a high-mass ring 18 coupled to both the sleeve 25 and the foam portion 40, which is located near, and is concentric with, the front aperture 17. The high-mass ring 18 provides the device 15 with a center of mass 19 optimized to create an efficient flight trajectory and an efficient aerodynamic orientation when thrown in a manner very similar to the throwing motion familiar to anyone who has thrown (or similarly launched) a football. The high-mass ring 18 can be made of any suitable material including (but not limited to): plastic or thermoplastic, such as elastic poly-vinyl chloride (PVC), high-density polyethylene (HDPE), high-performance polyethylene (HPPE), or Teflon; metal or alloy, such as iron, copper, steel, tungsten, or titanium; hardwoods or softwoods; or combinations thereof.

Alternatives to the high-mass ring 18 that would achieve the same desired effect include the use of steel shot or high-density foam near the front aperture 17 of any embodiment of the invention. It is optimal (though not required) for purposes of gripping, launching, and spinning the device 15 that the high-mass ring 18, or any equivalent area of high mass, be substantially elastic. Substantial elasticity of the high-mass ring 18 also enhances the safety of the device 15.

In particular embodiments, the ring 18 and the sleeve 25 are manufactured as a single unit made of polypropylene having a substantially equivalent mass distribution as the coupled ring 18 and the sleeve 25, instead of separate components. In other particular embodiments, the front half of the device 15 is made of a higher-density foam and the rear half is made of a lower-density foam, which results in a substantially equivalent mass distribution as in those embodiments that comprise the ring 18 and the sleeve 25 as separate components.

The location, dimensions, and mass of the high-mass ring 18 in the device 15 form one component of the overall design strategy to place approximately fifty percent (50%) of the mass of the device 15 within the first five percent (5%) to twenty-five percent (25%) of the length of the device 15 as measured from the plane of front aperture 17, in order to maximize the stability, efficiency, and lift generation of the device 15 in flight. Other components of this overall design strategy include: the location, dimensions, and mass of the sleeve 25; and the use of low-density foam 40 for the remaining portions of the tube wall 16. This strategy results in a center of mass 19 that is located approximately ten percent (10%) to twenty-five percent (25%) of the length of the tapering tube wall 16 as measured from the front aperture 17, with fifteen percent (15%) being optimal.

An area of higher hoop strength (the ability of a tube to withstand crushing forces) and increased stiffness is advantageous for providing an area for the thrower's hand or launcher's grip to firmly clasp the device 15 in order to more successfully aim, and impart spin on, the device 15 during launch without said firm clasping causing distortion or damage to the device 15. FIG. 4 depicts the stiffening sleeve 25 in the device 15, which provides such an area of higher hoop strength while still maintaining some elasticity, consistent with that of the high-mass ring 18. FIG. 4 shows that the elastic sleeve 25 is concentric with the high-mass ring 18 and the foam portion 40 of the tapering tube wall 16 and, in the device 15, the elastic sleeve 25 is located within the inner diameter of the high-mass ring 18. As with the high-mass ring 18, alternative materials to the use of polypropylene for the sleeve 25 exist, such as high-density foam.

In particular, non-limiting embodiments of device 15 depicted in FIG. 4 the high-mass ring 18 weighs about twenty grams to fifty grams, the sleeve 25 weighs about twenty grams to fifty grams, and the low-density foam portion 40 also weighs about twenty grams to fifty grams, for a total mass of about sixty grams to about one hundred fifty grams. In very particular, non-limiting embodiments of device 15 depicted in FIG. 4 the high-mass ring 18 weighs about forty grams, the sleeve 25 weighs about thirty grams, and the low-density foam portion 40 also weighs about thirty grams, for a total mass of about one hundred grams. In particular, alternative embodiments, the device 15 comprises a high-mass ring 18 weighing sixty grams, a sleeve 25 weighing twenty-five grams, and a low-density foam portion 40 weighing fifteen grams, for a total mass of one hundred grams.

The mass of each component, and the total mass, may vary among various embodiments of the invention. In specific alternative embodiments, the ratios of the masses of the components are substantially similar to the ratios of the masses of the components identified herein. For example, in one very particular, non-limiting embodiment of the device, the high-mass ring 18 comprises about forty percent (40%) of the device's mass, the sleeve 25 comprises about thirty percent (30%) of the device's mass, and the low-density foam portion 40 comprises about thirty percent (30%) of the device's mass. In one very particular, alternative, non-limiting embodiment, these three components of the device make up sixty percent (60%), twenty-five percent (25%), and fifteen percent (15%) of the device's mass, respectively. The configurations identified herein can be scaled up or down to achieve larger or smaller versions of the device 15. By way of example, but not of limitation, scaled-up versions of the device 15 weigh up to four hundred grams of total mass or measure up to five inches in outermost diameter, as in FIG. 13. Embodiments of the invention designed for hunting or munitions purposes will weigh substantially more.

Figure 5:
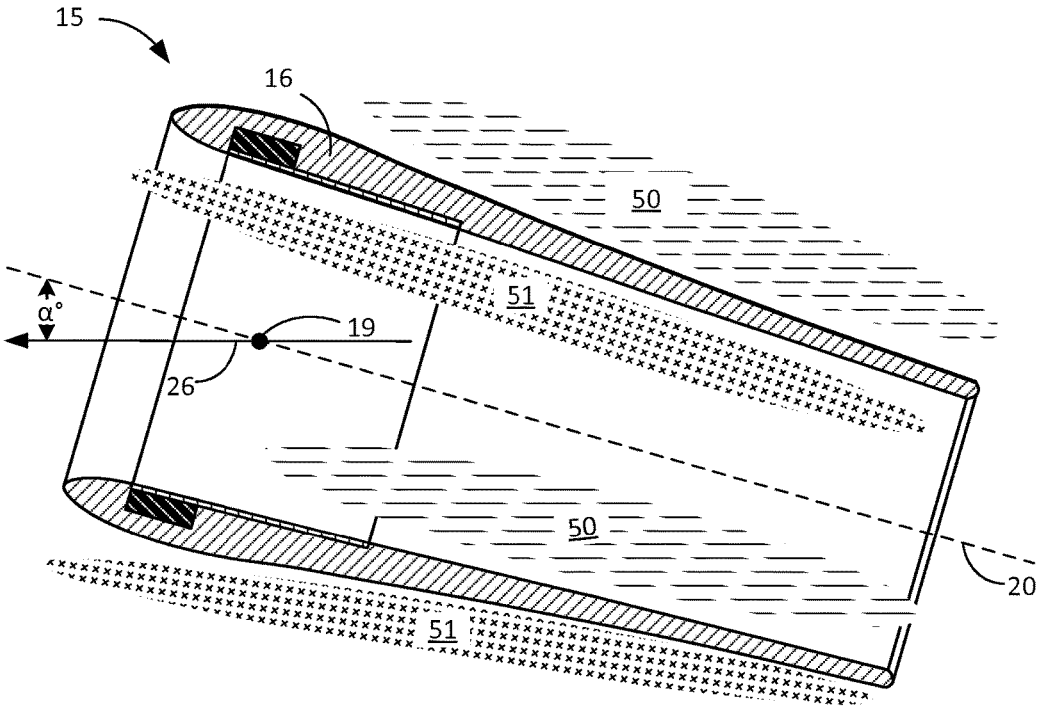
FIG. 5 is a side view of a longitudinal section of the device of FIG. 1 that illustrates certain of its understood aerodynamic characteristics during flight.

FIG. 5 depicts the device 15 during the gliding portion of a flight trajectory 26. The angle of attack $\alpha$ of the tapering tube wall 16 airfoil is the angle between the spinning axis 20 and the overall flight trajectory 26 of the device 15. In flight, the device 15 is understood to generate areas of low pressure 50 and areas of high pressure 51 as the tube wall 16 airfoil spins through the air, which in turn generates lift and thus extends the duration and length of the flight of the device 15.

Figure 6:
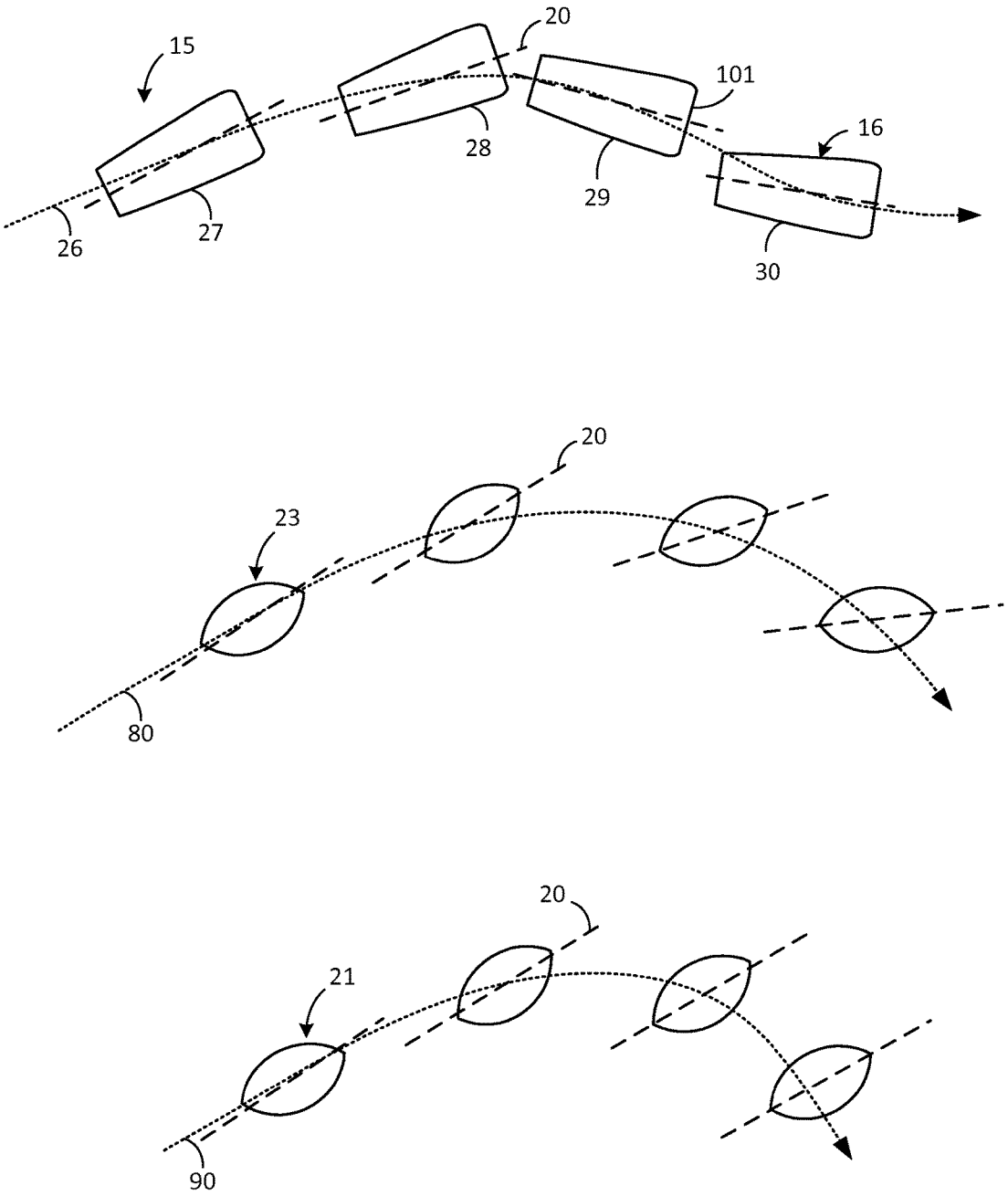
FIG. 6 is a diagram of the general flight trajectories of: the device of FIG. 1 as shown in a side view; a traditional pneumatic (inflated) football; and a single-density foam football.

The above-described characteristics of the device 15 are all designed to optimize its performance in flight. FIG. 6 depicts a flight trajectory 26 for the device 15. At the beginning of the flight trajectory 27, the low frontal area of the device 15 allows for an efficient initial throw. At the apex of the flight trajectory 28, the device 15 enters a soft stall. At the beginning of the downward portion of the flight trajectory 29, gravity pulls the front edge 101 of the device 15 downward, returning the device to an orientation with low frontal area and thus increasing the velocity of the device 15. As the device 15 enters the final phase of the flight trajectory 30, the tube wall airfoil 16 utilizes the speed gained after the apex 28 of the flight trajectory 26 to generate lift that flattens the flight trajectory 26 and extends the flight distance of the device 15. By comparison, the flight trajectory 80 of the pneumatic football 23 and the flight trajectory 90 of the foam football 21 both deteriorate significantly after reaching their apex, presumably because they do not generate nearly as much lift as they do drag and because their already large frontal area increases when the ball deviates from a perfect spiral due to its inability to store sufficient angular momentum.

Figure 7:
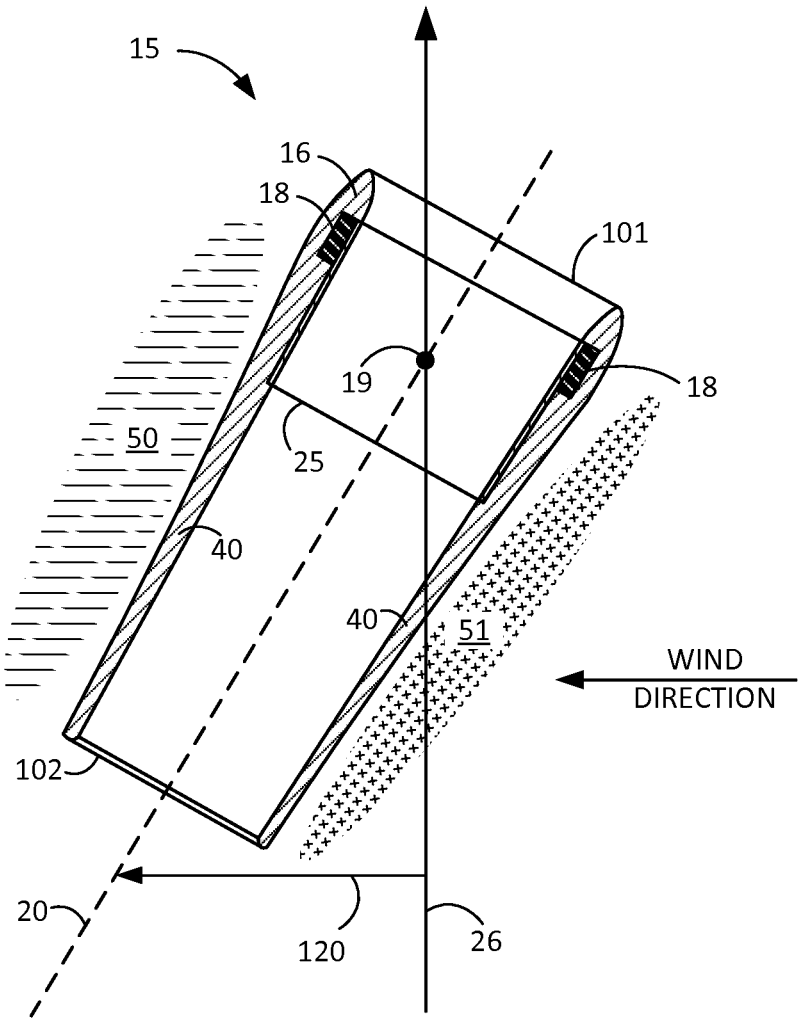
FIG. 7 is a top view of a longitudinal section of the device of FIG. 1, as viewed along line 7-7 of FIG. 2, that illustrates certain of its other understood aerodynamic characteristics when wind is coming from the right of the thrower or launcher, and the device is thrown right-handed (or launched consistent with a right-handed throw) so as to have the device spin counterclockwise when viewed from the leading, or front, edge.

Additionally, and as depicted in FIG. 7, the length and mass distribution along the spinning axis 20 of this embodiment of the device 15 add an aeronautical characteristic not present in any flying gyroscope or football: the ability, under certain circumstances, to tack into the wind. As described above, the configuration of the launchable flying device 15 locates the high-mass ring 18 and the sleeve 25 near the front aperture 17 and the front edge 101 of the tube wall airfoil 16. In contrast, the rear edge 102 of the tube wall airfoil 16, consisting only of the low-density foam portion 40, has relatively low mass.

FIG. 7 depicts the rearmost section of the device 15 acting as a tail, reacting to wind (as indicated by tail movement vector 120) by turning the spinning axis 20 "into" the wind when the wind comes from the same side of the thrower as the hand with which the device 15 is thrown (e.g., when the wind comes from the right hand side of a right-handed thrower). This enables the device 15 to "tack" into the wind even as the center of mass 19 maintains the initial direction imparted at launch. This ability to turn into the wind under certain conditions helps the launchable flying device maintain a low frontal area during flight by keeping the long axis of the device parallel to the direction of the wind.

As discussed above, the apertures 17 and 45 of the launchable flying device 15 have different diameters, creating a shape that tapers at an angle β of approximately one degree (1°) to four degrees (4°), which shape greatly influences the launchable flying device's flight characteristics. Early embodiments of the launchable flying device that did not have this taper were not able to tack into the wind and would be blown in the direction of the prevailing wind. Furthermore, these early versions would fly perpendicular to the face of the wind regardless of the direction of that the mass of the device was thrown.

The high-mass ring 18 multiplies and stores the spinning torque that is applied to the device 15 during launch as angular momentum. Due to the lever arm supplied by the location of the high-mass ring 18 near the outermost diameter of the tube wall 16, which is the greatest possible distance from the spinning axis 20.

The angular momentum "L" of a particle about a given axis, is defined as:

$$L=r\times p$$

where r is the position of the particle relative to the axis, p is the linear momentum of the particle (calculated as the product of the particle's mass and velocity), and × denotes the cross product. The angular momentum of a system of particles (e.g., a rigid body such as a football or the device 15) is the sum of angular momenta of the individual particles. The absolute value of the angular momentum of a rigid body rotating around a fixed spinning axis is the product of the absolute value of r⊥ (the lever arm distance from the fixed spinning axis to the center of mass of the rigid body) and the absolute value of p:

$$|L|=|r\perp||p|$$

Assuming that the same amount of linear momentum p is applied to different spinning objects, it becomes clear that the distance at which the center of mass is be located from the spinning axis is the key determining factor of how much angular momentum a given spinning object can store.

Figure 8:
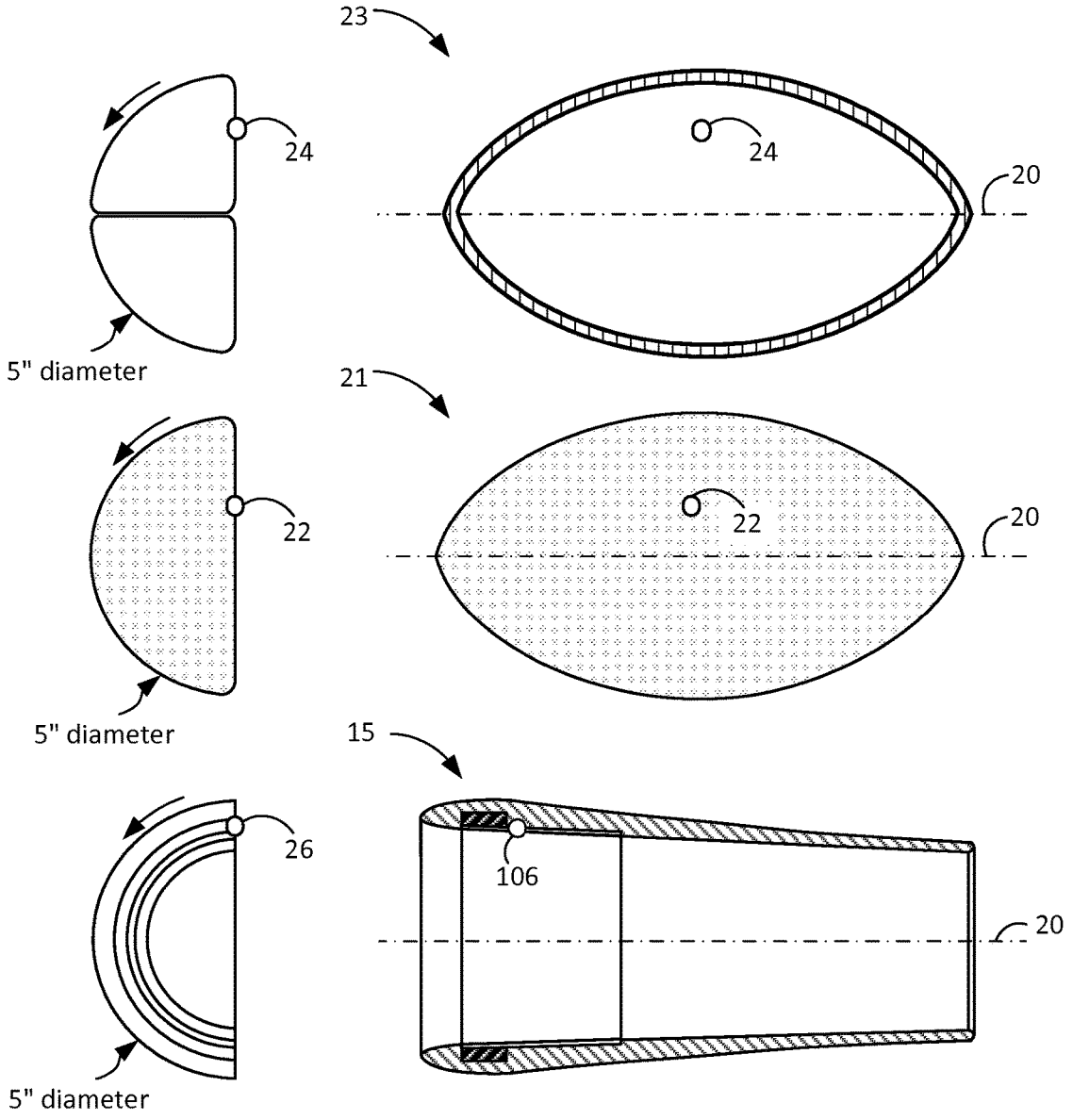
FIG. 8 illustrates the differences in the center of mass relative to the spinning axis, and hence angular momentum, between: a traditional pneumatic (inflated) football, a single-density foam football; and the device of FIG. 1, each of which is depicted in a partial end view as seen from the leading, or front, edge and in a longitudinal section view.

FIG. 8 depicts the significant superiority of the configuration of the mass of the device 15 when it comes to storing angular momentum. Applying the formula $$|L|=|r\perp||p|$$

with the assumption that the same linear momentum p (here, p=1.0) is applied to each spinning object, it is clear that the device 15, which has a center of mass relative to the spinning axis 106 located near the outermost diameter of the tube wall 16, can store the most angular momentum $$2.25=2.25\times1.0$$

when compared to the evenly distributed mass of a foam football 21 having a center of mass relative to the spinning axis 22

$$=1.0\times1.0$$

and also when compared to the double-taper-to-the-spinning-axis distribution of mass embodied in the shape of a pneumatic football 23 having a center of mass relative to the spinning axis 24

$$1.25=1.25\times1.0$$

even when assuming a substantially identical outermost diameter of five inches (which would involve scaling down a regulation football and scaling up the device depicted in FIGS. 1-6).

Locating both the center of mass 19 and center of mass relative to the spinning axis 106 near the front of the device 15 and locating the angular momentum at the greatest distance from the spinning axis results in: more spin momentum, which keeps the axis of rotation more oriented with the direction of the throw, which keeps the frontal area of the device 15 to a minimum during flight and reduces drag while exposing a maximum of the airfoil surface to the air and generating lift; tilting the nose of the device 15 down after the apex of the flight trajectory, which allows the device 15 to generate lift and extend the flight distance in the second half of its flight trajectory.

Figure 9:
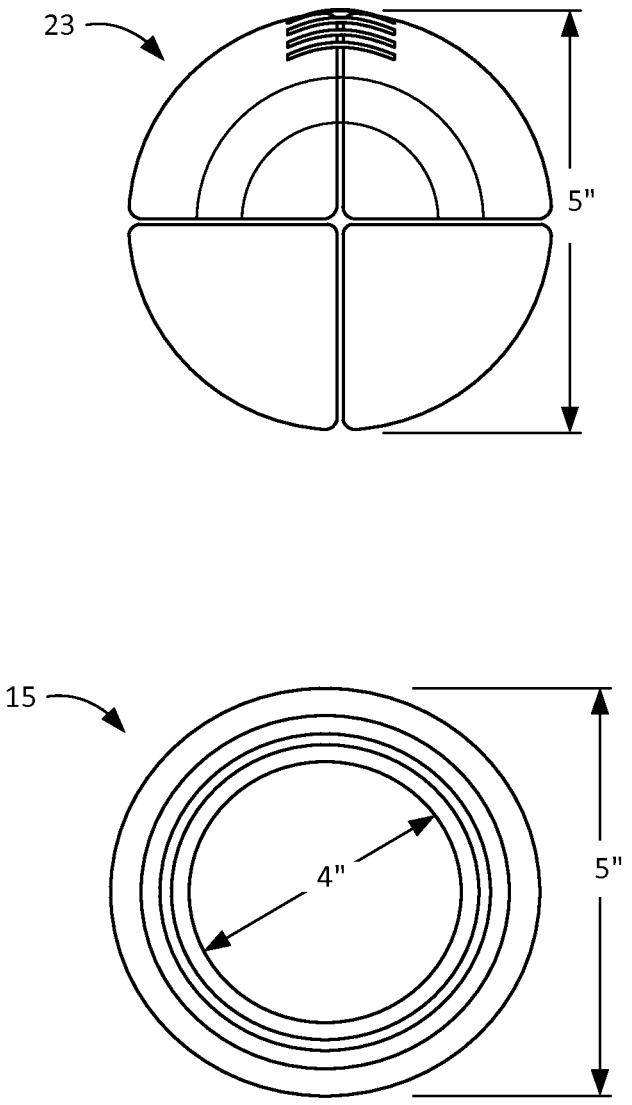
FIG. 9 illustrates the differences in frontal area, and hence drag, between a football and the device of FIG. 1, each of which is depicted in an end view as seen from the leading, or front, edge.

Another aerodynamic efficiency is gained by the decreased frontal area of the launchable flying device 15 in relation to the mass as compared to either a foam football 21 or pneumatic football 23 (which are substantially identical with regard to the frontal area of any football with a given outermost diameter). FIG. 9 depicts the device 15 compared to regulation pneumatic football 23 and shows that device 15 has a substantially reduced frontal area per unit of mass than regulation pneumatic football 23. Specifically, comparing a pneumatic football 23 and the device 15, each having an outermost diameter of five inches, and assuming that the innermost diameter of the device 15 is four inches, the pneumatic football has a frontal area of about nineteen and one-half inches:

$$\text{Area}=\pi r^2$$

If the radius r equals two and one-half inches, the frontal area equals it multiplied by 2.5 squared, or 19.63. The device 15 has the same outermost diameter, but has an innermost diameter of four inches, so:

$$\text{Area}=\pi r_o^2-\pi r_i^2$$

where $r_o$ is the outermost diameter and $r_i$ is the innermost diameter:

$$19.63-12.57=7.06$$

This means that the device 15 has approximately sixty-five percent (65%) less frontal area than a football with the same outermost diameter:

$$(19.63-7.06)/19.63=64.03\%$$

Thus, this embodiment of the device 15 encounters less air resistance (i.e., drag) when thrown through the air, leaving more energy to be used in maintaining both forward momentum along the trajectory and angular momentum (i.e., the aerodynamically stabilizing spinning that also optimizes lift generation).

Several other important design details have been identified as substantially affecting the performance characteristics of the launchable flying device. As one non-limiting example, varying the shape and length of the lift section of the airfoil alters the amount of lift that the invention can generate. As another example, varying the diameter, weight, mass, and shape of the elastic rubber ring alters the amount of angular momentum the invention will store. As yet another example, varying the location of the center of mass of the device alters the invention's ability to resist stall. As yet another example, varying the shape of the bottom of the leading edge of the airfoil alters the effective angle of attack and thus the power required to maintain the invention's rotation. Changes to these aforementioned design details and airfoil geometry are interdependent and result in changes to the performance envelope of the invention. Ideally, these aspects of the inventions will be varies and "tuned" so as to produce embodiments that have self-correcting mass-driven trajectories, which in turn allow the device to be easily and more predictably caught and thrown.

Figure 10:
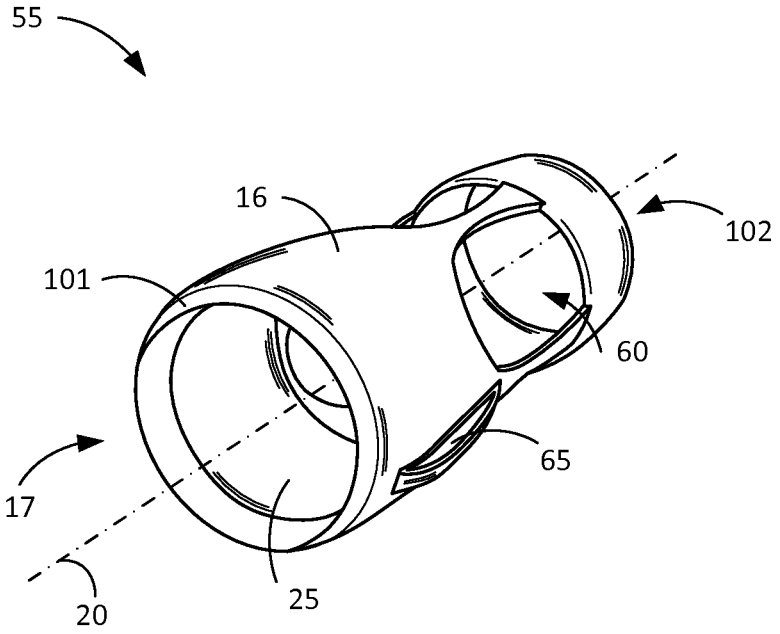
FIG. 10 is a front perspective view of one alternative embodiment of the launchable flying device as a toy which can be thrown or otherwise launched, distinguished by the presence of side apertures and a second cambered airfoil shape near the trailing edge.
Figure 11:
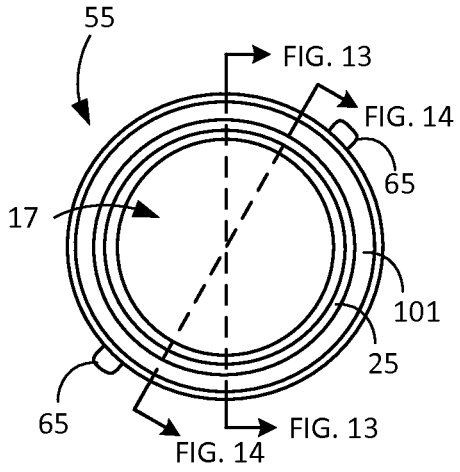
FIG. 11 is an end view of the device of FIG. 10 as seen from the leading, or front, edge.
Figure 12:
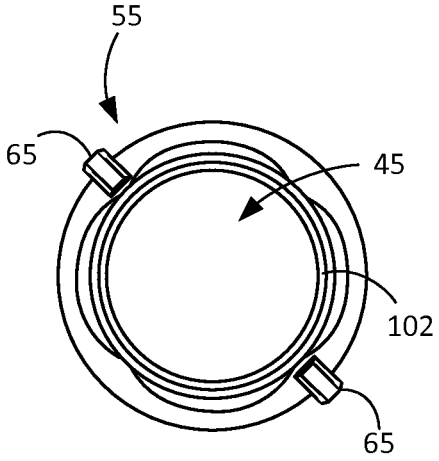
FIG. 12 is an end view of the device of FIG. 10 as seen from the trailing, or rear, edge.

An alternative embodiment that offers a unique mid-section and tail section of the invention is illustrated in FIGS. 10-14. FIG. 10 depicts another exemplary embodiment of the launchable flying device, generally indicated at 55. FIG. 11 depicts the device 55 as viewed from the front edge 101; FIG. 12 depicts the device 55 as viewed from the rear edge 102. The device 55 comprises a tapering tube wall 16 having a front aperture 17 with its perimeter being defined by the front edge 101 and a rear aperture 45 with its perimeter being defined by the rear edge 102. A spinning axis 20 comprises a line drawn through the centers of the apertures 17 and 45. FIGS. 10 and 12 show the tube wall 16 further comprises the sleeve 25 and the low-density plastic foam portion 40.

FIGS. 10-12 depict raised longitudinal grips 65 that provide extra grip for the thrower or launcher. Such straight longitudinal grips or, alternatively, grips that curve relative to the long axis of the invention, can be added in any quantity to any embodiment of the claimed invention, to enhance the ability of the user or launcher to grip, launch, and spin the device by providing a grip to enhance the impartation of rotational energy when the thrower throws the device. Also, the grip or grips provide a sensory cue to the thrower's fingers, indicating where the device should be held when thrown.

Figure 13:
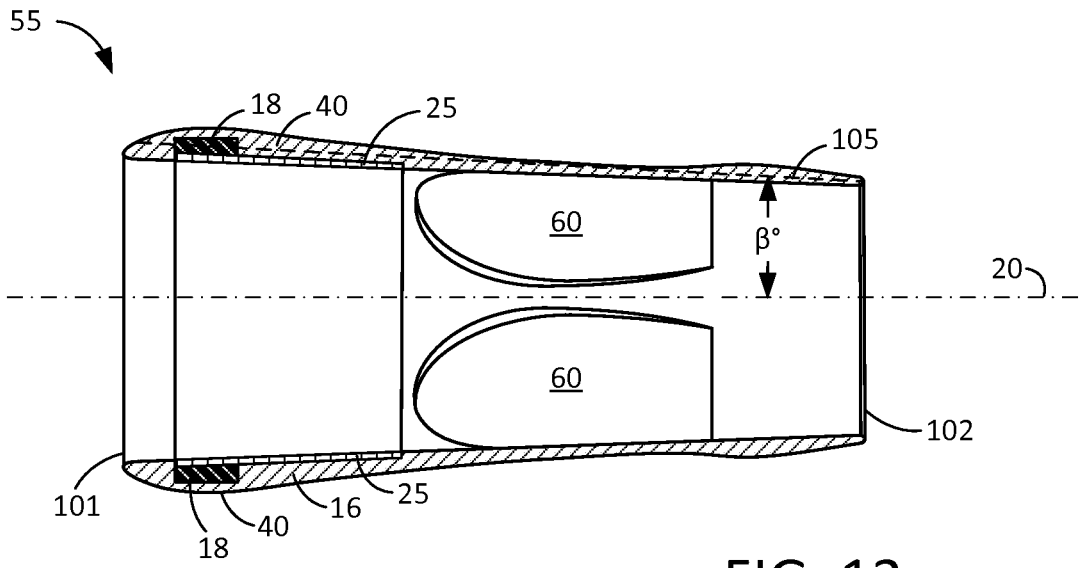
FIG. 13 is a side view of a longitudinal section of the device of FIG. 10, as viewed along line 13-13 of FIG. 11, that illustrates its cambered airfoil shapes and that also shows the center of mass of the device when it is not in motion.

FIG. 13 depicts the longitudinal section of the device 55. It can be seen that in this embodiment, the tapering tube wall 16 varies in thickness and thus comprises two cambered airfoil sections. A chord line 106 connects the point of maximum curvature of the front edge 101 of the airfoil to the point of maximum curvature of the rear edge 102 of the tube wall 16. That chord line 106 tapers consistently, relative to the spinning axis 20, at an angle β of about one degree (1°) to about four degrees (4°) along the length of the device 55.

The removal of large portions of the middle area of this embodiment 55 allows for a different design look while retaining all of the desired performance benefits. Experimentation has shown that the mid-section of the airfoil shape of the invention does not provide much lift, due to the termination of the lift section of the airfoil at the beginning of the mid-section, and that the tail section acts as a rudder, steering it into the wind, because of the long lever arm created by the tail end's long distance from the center of mass. As a result, various sections of various sizes and shapes can be removed from the midsection without fundamentally altering the performance of the invention.

Figure 14:
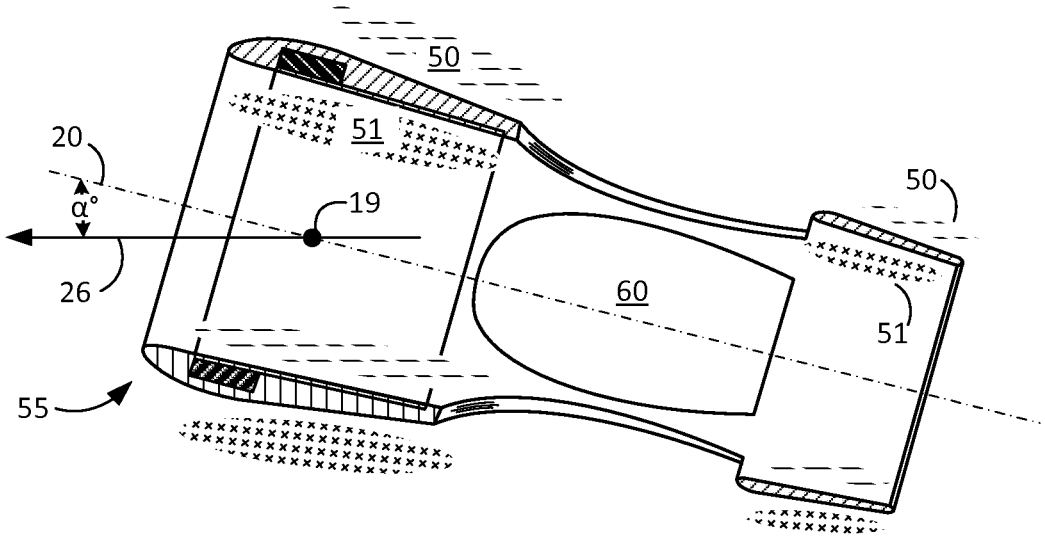
FIG. 14 is longitudinal section that bisects the side aperture of the device of FIG. 10, as viewed along line 14-14 of FIG. 11, which illustrates some of its understood aerodynamic characteristics during flight.

The removal of these areas, leaving the open spaces 60 that are depicted in FIGS. 10 and 13-14, adds some drag to the device while adding an opportunity to shape the portion of the tube wall 16 adjacent to the rear edge 102 into a second, separate cambered airfoil section, as depicted in FIGS. 10 and 13-14, for potential additional lift. The presence of a second airfoil shape in the device 55 allows it to generate areas of low pressure 50 and areas of high pressure 51 as the tube wall 16 airfoil spins through the air, which generates lift and thus extends the duration and length of the flight of the device 55.

These changes may add more complicated forces not present in other embodiments of the invention that lack such side apertures 60. The side apertures 60 can vary in shape, size, and location, depending on the specific goals of a specific embodiment of the invention.

All of these basic characteristics and design details are coupled dependencies that affect each other and the performance of the device. The launchable flying device is demonstrably superior to foam or pneumatic footballs at meeting goals of performance and safety, while being manufacturable using existing methods.

Any suitable or desired materials may be used to construct embodiments of the invention, including all materials (and combinations of materials) used to construct other flying devices including (but not limited to) various types of wood, metal, plastic, natural or synthetic leather or fabric, and resins. However, certain embodiments employ modern, lightweight, lower density materials in construction, such as expanded polypropylene (EPP), expanded polyethylene (EPE), Styrofoam®, polyethylene, polyurethane, and the like. Other embodiments utilize natural or sustainable materials, such as bamboo, balsa, laminated wood products, plant-derived plastics, or recycled metals, such as aluminum, steel, or titanium. Combinations of any such materials also may be used to construct embodiments of the invention.

Some embodiments of the invention have a multi-piece construction where separate pieces are attached or coupled together using adhesive, bonding agent, or a mechanical couple (such as screws or bolts). In other embodiments, however, an embodiment of the invention is constructed from injection-molded foam or plastic as a unitary piece or from separate pieces co-molded together. In still other alternative embodiments, the invention can be constructed as an exoskeleton using rotational molding or spin casting. Whether constructed from a single piece of material or from multiple pieces coupled together, any embodiment can also be machined or otherwise modified to impart particular desired characteristics, such as modifications that provide further airfoil surfaces or features.

The present inventive subject matter has been described in some detail for the purposes of clarity and understanding and with reference to one or more particular embodiments. However, those skilled in the art will recognize that many changes may be made thereto without departing from the spirit and scope of the subject matter disclosed and claimed herein.

I claim:

1. A launchable flying device, comprising:

a tapering tube comprising a stiff sleeve coupled to the inside of a foam tube wall, the tapering tube further comprising a front end and a rear end, wherein said front end further comprises a front aperture and said rear end further comprises a rear aperture, wherein said tube wall further comprises a leading tube edge and a trailing tube edge, and a high-mass ring coupled to the tube wall adjacent the leading tube edge within the first five percent to twenty-five percent of the length of the device as measured from the leading rube edge, wherein said leading tube edge also comprises the perimeter of said front aperture and said trailing tube edge also comprises the perimeter of said rear aperture, wherein the plane of said front aperture is substantially parallel to the plane of said rear aperture, wherein said front aperture has a diameter greater than said rear aperture, wherein the outermost diameter of said rube wall is no more than one hundred percent of the length of said tube wall, the length of said rube wall being the distance between said leading tube edge and said trailing tube edge, and wherein the center of mass of the device is located about ten percent to about fifteen percent of the length of the tapering tube wall as measured from the front aperture.

2. The device of claim 1, wherein the tube wall further comprises a plurality of apertures.

3. The device of claim 1, wherein the tube wall comprises a single cambered airfoil, and wherein the outermost diameter of said tube wall is from about thirty-five percent to about sixty percent of the length of said tube wall.

* * * * *